US006102973A

United States Patent [19]

Morales

[11] Patent Number: 6,102,973

[45] Date of Patent: Aug. 15, 2000

[54] PROCESS FOR TREATING GARMENTS

[76] Inventor: Rodolfo A. Morales, 9921 Goby, El Paso, Tex. 79924

[21] Appl. No.: 08/538,172

[22] Filed: Aug. 23, 1995

Related U.S. Application Data

[63] Continuation of application No. 08/086,811, Jul. 20, 1993, abandoned.

[51] Int. Cl.[7] ..... D06M 13/322

[52] U.S. Cl. ..... 8/185; 8/181; 8/182; 8/184; 8/186; 8/187; 8/188; 8/115.6; 8/115.7; 8/149.3; 8/115.58; 223/57; 38/144

[58] Field of Search ..... 8/181, 182, 184, 8/185, 186, 187, 188, 115.6, 115.7, 149.3, 115.58, 918; 223/57; 38/144

[56] References Cited

U.S. PATENT DOCUMENTS

| | | | |
|---|---|---|---|
| 4,208,301 | 6/1980 | Gammon | 252/321 |
| 4,396,391 | 8/1983 | North | 8/181 |
| 4,447,241 | 5/1984 | Hendrix | 8/182 |
| 5,013,378 | 5/1991 | Farah | 156/226 |

OTHER PUBLICATIONS

Turner, "Improving Durable Press Properties of Garment Dyed Goods", Cotton Incorporated, Feb. 25, 1988, pp. 1–9.

Barbery, "Garment Finishing", AATCC Symposium, Long Beach, CA, Nov. 8, 1991, pp. 1–7.

Two Recent Developments in Durable Press Finishing of Cotton Fabrics, John D. Turner, (Date Unknown).

A Pressing Need for a New Wrinkle—DP Finishing of Garment Dyed Products, Richard Brown Charles Tomasino Jimm C. Barbery John D. Turner and Don Jones, (Date Unknown).

Garment Finishing, Jimm C. Barbery, AATCC Symposium Long Beach, CA, Nov. 8, 1991.

Improving Durable Press Properties of Garment Dyed Goods, John D. Turner, Cotton Incorporated, Feb. 25, 1988.

Appearance of Durable Press Fabrics After Repeated Home Laundering, AATCC Technical Manual, (Month Unknown) 1988.

Appearance of Creases in Durable Press Items After Repeated Home Laundering, AATCC Technical Manual, (Month Unknown) 1988.

*Primary Examiner*—Alan Diamond
*Attorney, Agent, or Firm*—Alston & Bird, LLP

[57] ABSTRACT

A method for imparting durable press and softness characteristics to garments. The initial step of the process is to start with a garment in which the pH is between about 6 and 7. The garments are immersed in a mixture of water, a non-ionic wetter, a glyoxal resin and aminofunctional silicone, and a cationic HDPE in specific amounts, depending upon the type of fabric of which the garments are made. The mixture is extracted from the garments to a specific extent. After mixture extraction, the garments are pressed and baked.

12 Claims, No Drawings

PROCESS FOR TREATING GARMENTS

This application is a Continuation of application Ser. No. 08/086,811, filed Jul. 20, 1993 now abandoned.

BACKGROUND AND SUMMARY OF THE INVENTION

The present invention relates to processes and methods for treating garments. In particular, the invention relates to the treatment of garments made of cotton, cotton blends and synthetic fabrics for the purpose of imparting durable press properties thereto.

A variety of techniques and additives have been suggested for use in the treatment of such fabrics to obtain durable press properties. Suggestions include those contained in a paper entitled *Garment Finishing* by Jimm C. Barbery, dated Nov. 8, 1991 AATC Symposium, Long Beach, Calif. Barbery suggests the use of a precatalysed low-formaldehyde glyoxal resin (10%), a non-ionic wetter (0.2%), an amino-functional silicone (3%), a cationic high density polyethylene (2%), and acetic acid—56% (0.1%) in aqueous solution wherein water comprises the remaining 84.7%. Barbery suggests loading the machine with the garments prior to the addition of the liquid mix components. Barbery also suggests that once the mixture components are added, the garments be allowed to soak for between six and ten minutes without agitation. Finally, Barbery suggests that the garments be pressed and cured.

In a paper entitled *A Pressing Need for a New Wrinkle—DP Finishing of Garment Dyed Products,* by Richard Brown, Charles Tomasino, Jimm C. Barbery, John D. Turner and Don Jones (date of publication unknown), published by the research committee of the Northern Piedmont Section of AATCC, the authors thereof suggest that a process similar to the one described in the Barbery paper be applied to garments which have been garment dyed. Again, the AATCC paper, the use of acetic acid (56%) is suggested. The AATCC paper describes a formulation containing methylated DMDHEU (dimethylol dihydroxethylene urea) and does not indicate that a functional silicone was used.

In a paper entitled *Two Recent Developments in Durable Press Finishing of Cotton Fabrics* by John D. Turner of Cotton, Inc., (date of publication unknown), Turner suggests the use of amino silicone alone and, as an alternative, in combination with diethylene glycol and coco-diethanolamide. In addition, Turner suggests the addition of acetic acid (100%) in the amount of 0.2% as a percentage of the bath weight. The Turner formulation also included high density polyethylene. The Turner process is directed to fabrics, not garments, as evidenced by Turner's concern about sewing lubrication.

In another paper by Turner of Cotton, Inc. entitled *Improving Durable Press Properties of Garment Dyed Goods,* dated Feb. 25, 1988, Turner suggests the use of etherified DMDHEU (5%–15%), magnesium chloride hexahydrate (1.5%–4.0%), acetic acid (0.1%–0.2%), and a polyethylene softener (2.0%–5.0%). The finish mixture is applied to garments which are still wet from the dying process. Turner does not suggest the use of any wetting agent. Since the garments treated in the Turner process are already wet from the dying process, determining the proper formulation is difficult and the degree of agitation required to ensure the proper amount of resin is deposited in the garments is difficult and imprecise.

The processes and methods of the present invention constitute an improvement upon the foregoing techniques.

In particular, the present invention provides a commercially practicable method for imparting durable press characteristics to fabrics containing cotton. Garments treated by the methods set forth herein may be made to have durable press and softness characteristics which are both superior and consistent from batch to batch.

The present invention provides a technique for maximizing the durable press characteristics while maintaining an acceptable level of garment wear and durability.

BRIEF DESCRIPTION OF THE INVENTION

Improved durable press and softening characteristics can be obtained in garments by following a procedure in which the garments initially have a fabric pH of between 6 and 7. The garments should be clean, absorbent and free of size, waxes, loose dyes and the like. In the case of garments made of denim the garments should be pre-washed, and, if desired, a stone wash or enzyme wash may be used. Depending upon the percentage of cotton, if any, in the fabric comprising the garment, different amounts of precatalyzed, low-formaldehyde glyoxal resin and cationic amino functional silicone in an aqueous emulsion are used. Further, depending upon whether the garments contain dyes, a defoamer and a dye fixer will be used. In all cases, a linear alcohol non-ionic detergent is added to the mixture as a wetting agent. After the garments have been treated with a mixture containing the foregoing components in appropriate proportions, the garments are dried to a specific degree, i.e. between 11% and 15% moisture content to make sure that proper amounts of the components of the mixture remain with the garment. Before the garments are allowed to dry further, for example, before approximately 12 hours have passed depending on the weight of the fabric, the garments are pressed in accordance with a procedure more thoroughly described herein. Finally, the garments are pressed and cured by being exposed to relatively high temperature of between approximately 290° F. and 320° F. By following the procedures set forth herein, excellent results have been obtained in producing garments having durable press characteristics, even in garments which contain up to 100% cotton.

DETAILED DESCRIPTION OF THE INVENTION

The first step in practicing the present invention is to make sure that the garments to be treated have a pH in the range of between 6 and 7, and that the alkalinity of the garment is less than about 0.05% (as NaOH) The garments must be clean, absorbent, free of size, waxes and loose dyes. As used herein, the term "garment" is intended to refer to articles of clothing including slacks, shirts, and other similar items for which durable press and softness characteristics may be desirable. Most suppliers of non-denim fabric can produce fabrics in accordance with these requirements. However, it has been found that denim suppliers have difficulty meeting such requirements, Therefore, it is often necessary to wash denim products prior to their being treated for durable press characteristics. As a practical matter, however, because of fashion concerns, most denim products are now required to be pre-washed in some manner, either with a stone wash process or an enzyme wash process, and the requirement that denim garments be treated in order to maintain the proper pH is not a significant problem.

Garments with the proper pH, i.e. between 6 and 7, are immersed in a mixture generally comprising some combination of the following components:

Component A: a wetting agent, preferably a linear alcohol ethoxylate, which is non-ionic and highly biodegradable;

Component B: a glyoxal resin, preferably a glycolated DMDHEU (dimethylol dihydroxethylene urea), with a magnesium chloride catalyst, and containing extremely low levels of formaldehyde (less than 0.5%);

Component C1: a high density polyethylene in an aqueous emulsion with cationic emulsifiers;

Component C2: a high density polyethylene in an aqueous emulsion with non-ionic emulsifiers;

Component D1: a cationic amino functional polysiloxane in an aqueous emulsion, preferably containing a fatty-amine chemically tied to the backbone of the polysiloxane;

Component D2: an aqueous emulsion of silicone fluid made with non-ionic emulsifiers;

Component E: (for colored garments only), a defoamer, preferably a composition of high molecular weight paraffinic oil and alkoxylated surfactants of polyether ester character;

Component F: (for colored garments only), a dye fixer, preferably an aqueous solution of a cationic polymer.

The above components, when called for to meet a particular application, are combined with water in a garment washing machine. Generally, the components are added one at a time while the machine is stopped, and with the water added first. Without the garments in the machine, the components and the water are mixed with regular agitation for approximately 3 to 4 minutes. After the components are mixed thoroughly in water, the garments are added to the machine. The garment and mixture are mixed together for approximately 10 minutes. However, when garments made of sanded or brushed fabrics are being treated, no agitation should be used. Care should be taken not to add garments to the machine until the components of the mixture are thoroughly mixed with the water. A small amount of water, about 15 gallons, should be reserved to rinse containers used to transport the other components to the machine.

The polysiloxane listed above as component D1 and the silicone fluid listed above as component D2 are examples of silicon based polymers which may be used to provide the garment with a soft feel.

The foregoing generally described invention is exemplified by the following examples which are illustrative of the invention:

EXAMPLE 1

For treating white 100% cotton fabric garments with fabric weights of various types, not including denim, a mixture containing the following amounts of the above-described components was prepared:

| Component: | Percent of Mixture by Weight: |
|---|---|
| A (wetting agent) | 0.1% |
| B (glyoxal resin) | 9.0% |
| C2 (HDPE) | 3.0% |
| D2 (silicone fluid) | 3.0% |
| Water | 84.9% |

For non-denim fabrics which are white, the foregoing formulation should be without the addition of a dye fixer (Component F). In addition, since foam control products tend to cause yellowing in white fabrics, the preferred formulation for white garments made of 100% cotton does not include a defoaming agent.

EXAMPLE 2

The second example of the present invention is one for use with 100% cotton, non-denim garments which contain dyed fabric. In this example, a mixture of the following amounts of the above described components were prepared. A dye fixer, approximately in the amount of 0.5% of the total weight should be added in order to help prevent fading due to the loss of dye from the garments.

| Component: | Percent of Mixture by Weight: |
|---|---|
| A (wetting agent) | 0.1% |
| B (glyoxal resin) | 9.0% |
| C1 (HDPE) | 3.0% |
| D1 (polysiloxane) | 3.0% |
| Water | 84.9% |

EXAMPLE 3

Garments made of 100% cotton which are non-denim and which are brushed or sanded goods) should be treated with a mixture as follows:

| Component: | Percent of Mixture by Weight: |
|---|---|
| A (wetting agent) | 0.1% |
| B (glyoxal resin) | 9.0% |
| C1 (HDPE) | 3.0% |
| D1 (polysiloxane) | 6.0% |
| Water | 81.9% |

The foregoing mixture should be used without a defoamer or dye fixer for garments which do not contain dyes i.e. white garments. However, as discussed with respect to Example 2 above, a dye fixer in the amount of approximately 1.5% should be added to dyed garments. No agitation of the garments in the mixture should be done. Agitation of brushed or sanded garments may detrimentally affect the appearance and hand of the garments.

EXAMPLE 4

Garments made of 100% cotton denim should be treated with a mixture as follows:

| Component: | Percent of Mixture by Weight: |
|---|---|
| A (wetting agent) | 0.1% |
| B (glyoxal resin) | 7.0% |
| C1 (HDPE) | 3.0% |
| D1 (polysiloxane) | 6.0% |
| Water | 83.9% |

As discussed above with respect to Example 1, the foregoing mixture should be used with white garments. However, as discussed with respect to Example 2, if garments containing dye are to be treated, a dye fixer in the amount of approximately 1.5% should be added.

EXAMPLE 5

Garments made of a blend of cotton and polyester may be treated with a mixture which contains somewhat less resin than the 100% cotton non-denim garments discussed in connection with Examples 1 through 3. The mixture for blends should contain the following components in the following amounts:

| Component: | Percent of Mixture by Weight: |
|---|---|
| A (wetting agent) | 0.1% |
| B (glyoxal resin) | 7.0% |
| C1 (HDPE) | 3.0% |
| D1 (polysiloxane) | 3.0% |
| Water | 86.9% |

As discussed above with respect to Example 2, the foregoing mixture without defoamer or dye fixer should be used for white garments. If garments containing dye are to be treated, a dye fixer in the amount of approximately 1.5% may be added.

EXAMPLE 6

For garments which are made of synthetic materials, such as 50% polyester and 50% rayon, or 50% polyester, 25% rayon and 25% acrylic, should be treated with a mixture containing the following components in the following amounts:

| Component: | Percent of Mixture by Weight: |
|---|---|
| A (wetting agent) | 0.1% |
| B (glyoxal resin) | 7.0% |
| C1 (HDPE) | 3.0% |
| D1 (polysiloxane) | 1.5% |
| Water | 88.4% |

As discussed above with respect to Example 2, the foregoing mixture without defoamer or dye fixer may be used for white garments. If garments containing dye are to be treated, a dye fixer in the amount of approximately 1.5% may be added.

After the garments have been agitated, or soaked in the case of garments made of brushed or sanded fabrics, in the treatment mixture for the specified period of approximately 10 minutes, the mixture is extracted from the garments so as to leave the garments with between about 70% and 80% wet pick-up, based on the dry weight of the garments. For example, a load of dry garments weighing 1000 lbs. before being immersed in the treatment mixture should weigh between about 1700 lbs. and 1800 lbs. when they are unloaded after extraction of the mixture and before being dried in a dryer.

It should be noted that the C and D components, i.e. the HDPE and the silicon based polymers, respectively, should be matched with each other with regard to their ionic character. In Example 2 the C1 component and the D1 component are both cationic, and in Example 1, the C2 and D2 components are both non-ionic. In all cases, the effectiveness of the various components is best if the use of anionic and cationic components in the same mixture is avoided. Thus, a non-ionic wetting agent may be used with the mixture of both Example 1 (non-ionic) and Examples 2 through 6 (cationic).

A defoamer, Component E, in an amount approximately 0.1% of the total weight, is added. A defoamer known as VERCODEFOAMER NS-200 available from Virkler of Charlotte, N.C., has been found to be an effective defoamer for purposes of practicing the present invention. The manufacturer describes VERCODEFOAMER NS-200 as being a synergistic composition of high molecular weight paraffinic oils and alkoxylated surfactants of polyether ester character. The specifics of the molecular weight and other details of the defoamer are not known. It may not be necessary to add a defoamer to the mixture itself. It may only be necessary to add a defoamer to the portion of the mixture which is left over after the garments have been treated (waste liquid). A defoamer added to the waste liquid will minimize foaming for purposes of discarding the waste liquid into a system which eventually cleans or treats the waste liquid at a waste water treatment location.

The garments treated in accordance with the foregoing examples should all be dried to between approximately 11% and 15% moisture as measured by a portable moisture monitor, such as one available from the Strandberg Engineering Laboratories, Inc. If the garments are dried beyond this moisture content level, there may not be sufficient resin and other components of the treatment mixture left in the garment to obtain the desired characteristics. On the other hand, if the garments are not dried to the target moisture level, they may contain too much of the components in the mixture with the result that the garments will not have sufficient durability.

The amount of time required to reach the target moisture level will depend on the weight of the fabric, the temperature of the dryer, the duration of the drying cycle, and the extent to which the garments are tumbled. However, it is important to keep the drying temperature below a temperature which will cause the resin to set. Therefore, for the resins used in the foregoing examples, the drying temperature should be kept below approximately 150° F.

Once the garments have been dried to the proper moisture level, they are ready for the pressing and final cure steps. It is important to press and finally cure the garments without substantial delay, i.e. delay of more than approximately 12 to 24 hours, depending upon the weight of the fabric comprising the garments. Denim fabrics can be held between the drying and the pressing steps longer than lighter weight fabrics, because they tend to more readily retain moisture. Pressing of the garments in accordance with the present invention is done with a garment press capable of exerting a vacuum on the garment through the lower plate of the press. Initially, the garments are positioned with the aid of a vacuum to eliminate wrinkles and they are subsequently subjected to a steam treatment for approximately five seconds with the vacuum turned off. Steam is then applied to the garment through the top plate of the press for approximately 5 seconds. The steam is applied in combination with light clamping pressure in the amount of approximately 40 lbs. (178 newtons) After the steam is stopped, full pressure and heat are applied to the garment with the upper plate of the press. The full pressure and heat are applied so as to bring the temperature of the garment to about 290° F. The full clamping pressure during the final phase of the pressing cycle should be about 60 lbs. (267 newtons) to 70 lbs. (311 newtons), and should be held for approximately 5 seconds. After the full pressure and heat are applied, a brief (approximately 3 seconds) vacuum is applied to the garment in order to begin to control the amount of vapors to which the press operator is exposed and to cool the garment. After the garments have been pressed, they are hung on racks in such as way as to provide space of about 6 inches between each garment. The garment is then baked in ovens for approximately 15 minutes at a temperature of between approximately 290° F. to 320° F.

After the garments have been subjected to the baking cycle, they are allowed to cool and are then ready for shipment. While the foregoing process is particularly well suited for garments made of fabric containing at least some cotton, the process is applicable to garments containing synthetic fabrics alone.

Garments treated in accordance with the processes described above have excellent hand and exhibit substantial durable press characteristics.

It should be noted that none of the formulations described above with respect to the examples contain acetic acid. Requiring that the fabrics have a fabric pH of between 6 and 7 prior to their treatment in accordance with the present invention eliminates the need to add acetic acid to the treatment mix. Depending on the alkalinity or the acidity of the denim used to make some garments, the prewashing treatment of the fabrics may require the addition of acetic acid to either raise the pH or the addition of soda ash to lower the pH. However, in accordance with the present invention, this is done in a pre-wash process and not in connection with the durable press treatment cycle, and may not be required at all.

In connection with the pressing cycle, it has been found that the separate application of steam prior to the application of full heat and pressure provides a particularly effective durable press finish on the garment.

While specific embodiments of the invention have been shown and described, it will be apparent to those skilled in the art that numerous alternatives, modifications, and variations of the embodiment shown can be made without departing from the spirit and scope of the invention as set forth in the appended claims.

I claim:

1. A method of treating a garment to impart durable press characteristics comprising:

starting with a garment in which the fabric of the garment has a pH of between about 6 and about 7, preparing a mixture in a garment washing machine, said mixture comprising the following components at the following percentages of the total weight of said mixture, approximately 0.1% of a wetting agent, approximately 7.0% to approximately 9.0% of a glycolated dimethylol dihydroxethylene urea, approximately 3.0% of an aqueous emulsion of high density polyethylene, and between approximately 1.5% and approximately 6.0% of an aqueous emulsion containing a silicone based polymer, and between approximately 81.9% and approximately 88.4% water, agitating the mixture for approximately 3 to approximately 4 minutes, placing said garment in said machine and submerging said garment in said mixture for approximately 10 minutes, extracting the mixture from said garment so that said garment has a wet pickup of between approximately 70% and approximately 80%, based on the dry weight of said garment, drying said garment to a moisture level, as a percentage of maximum moisture content, of between approximately 11% to approximately 15%, subjecting said garment to a pressing cycle not more than approximately 24 hours after said garment has been dried, and baking said garment in an oven for approximately 15 minutes at a temperature of between approximately 290° F. and 320° F., wherein said aqueous emulsion containing a silicone based polymer is selected from the group consisting of an aqueous emulsion of silicone fluid made with non-ionic emulsifiers and an aqueous emulsion containing a cationic aminofunctional polysiloxane.

2. A method in accordance with claim 1 wherein:

said garment is white and said aqueous emulsion containing a silicon based polymer is an aqueous emulsion containing silicon fluid with non-ionic emulsifiers.

3. A method in accordance with claim 1 wherein:

said garment is dyed and said aqueous emulsion containing a silicon based polymer is an aqueous emulsion with a cationic aminofunctional polysiloxane.

4. A method in accordance with claim 1 wherein:

said pressing cycle comprises the steps of:

arranging said garment on the lower plate of a garment press with the aid of a vacuum applied to the garment through said lower plate, turning said vacuum off, applying steam to said garment through the upper plate of said press while applying pressure of not more than about 178 Newtons of clamping force to said garment with said upper and lower plates of said garment press, turning said steam off, increasing said clamping force to at least about 267 Newtons for about 5 seconds while said upper plate of said press is heated so as to raise the temperature of said garment to at least about 290° F.

5. A method in accordance with claim 1 wherein:

said garment is non-white and a defoamer comprised of paraffinic oils and alkoxylated surfactants is added to said mixture prior to the placement of said garment in said mixture, said defoamer being added in an amount equal to approximately 0.1% by weight of said mixture.

6. A method in accordance with claim 2 wherein:

the garment and said mixture are agitated together for said approximately 10 minutes.

7. A method in accordance with claim 1 wherein:

said garment is non-white and a dye fixer comprised of an aqueous solution of cationic polymers with non-ionic emulsifiers is added to said mixture prior to the placement of said garment in said mixture.

8. A method in accordance with claim 7 wherein:

the amount of said dye fixer is approximately 1.5% by weight of said mixture.

9. A method of treating a garment to impart durable press characteristics comprising:

starting with a garment in which the fabric of the garment has a pH of between about 6 and about 7, preparing a mixture comprising the following components at the following percentages of the total weight of said mixture, approximately 0.1% of a wetting agent, approximately 7.0% to approximately 9.0% of a glycolated dimethylol dihydroxethylene urea, approximately 3.0% of an aqueous emulsion of high density polyethylene, and between approximately 1.5% and approximately 6.0% of an aqueous emulsion containing a silicone based polymer, and between approximately 81.9% and approximately 88.4% water, agitating the mixture for approximately 3 to approximately 4 minutes, applying said mixture to said garment, and allowing said mixture to penetrate said garment for at least approximately 10 minutes, drying said garment to a moisture level, as a percentage of maximum moisture content, of between approximately 11% to approximately 15%, subjecting said garment to a pressing cycle not more than approximately 24 hours after said garment has been dried, and baking said garment in an oven for approximately 15 minutes at a temperature of between approximately 290° F. and 320° F., wherein said aqueous emulsion containing a silicone based polymer is selected from the group consisting of an aqueous emulsion of silicone fluid made with non-ionic emulsifiers and an aqueous emulsion containing a cationic aminofunctional polysiloxane.

10. A method in accordance with claim 9 wherein:

said garment is white and said aqueous emulsion containing a silicon based polymer is an aqueous emulsion containing silicon fluid with non-ionic emulsifiers.

11. A method in accordance with claim 9 wherein:

said garment is dyed and said aqueous emulsion containing a silicon based polymer is an aqueous emulsion with a cationic aminofunctional polysiloxane.

12. A method in accordance with claim 9 wherein:

said pressing cycle comprises the steps of:

arranging said garment on the lower plate of a garment press with the aid of a vacuum applied to the garment though said lower plate, turning said vacuum off, applying steam to said garment through the upper plate of said press while applying pressure of not more than about 178 Newtons of clamping force to said garment with said upper and lower plates of said garment press, turning said steam off, increasing said clamping force to at least about 267 Newtons for about 5 seconds while said upper plate of said press is heated so as to raise the temperature of said garment to at least about 290° F.

* * * * *